United States Patent [19]

Van der Hulst et al.

[11] Patent Number: 4,685,713

[45] Date of Patent: Aug. 11, 1987

[54] CONTAINER GRAB

[75] Inventors: Herman L. Van der Hulst, Nieuwleusen; Arend H. Meerman, Dedemsvaart, both of Netherlands

[73] Assignee: Indapp Engineering B.V., Netherlands

[21] Appl. No.: 795,539

[22] Filed: Nov. 6, 1985

[30] Foreign Application Priority Data

Nov. 9, 1984 [NL] Netherlands ..... 8403444

[51] Int. Cl.[4] ..... B66C 1/66; B66F 9/18

[52] U.S. Cl. ..... 294/90; 414/672

[58] Field of Search ..... 294/90, 104, 103.1, 294/92, 31.1, 15, 4; 414/607, 622

[56] References Cited

U.S. PATENT DOCUMENTS

| | | | |
|---|---|---|---|
| 2,905,347 | 9/1959 | Hopfeld | 414/622 |
| 3,310,336 | 3/1967 | Chenault | 294/90 |
| 3,794,371 | 2/1974 | Arboaw | 294/90 |
| 4,029,229 | 6/1977 | Hopson | 414/622 |
| 4,243,354 | 1/1981 | Garcia | 294/90 |

FOREIGN PATENT DOCUMENTS

| | | |
|---|---|---|
| 3312463 | 4/1983 | Fed. Rep. of Germany . |
| 2534896 | 10/1982 | France . |
| 7800419 | 4/1977 | Netherlands . |

*Primary Examiner*—James B. Marbert
*Attorney, Agent, or Firm*—John P. Snyder

[57] ABSTRACT

The invention relates to a container grab comprising co-operating jaws attached to a frame, between which jaws a container rim is to be accommodated, characterized in that the under jaw is attached to a carriage slidable along a frame column comprised in said frame and the upper jaw is attached to one end of a lever pivotally attached to said carriage, the other end of said lever being coupled via a link with said frame column. Preferably said carriage is provided with a hook element that co-operates as such with a material strip attached to said frame, that on sliding said carriage along said frame column as to bring the jaws in the closed position, said hook element hooks behind said strip locking the pair of jaws against an undesired opening.

18 Claims, 7 Drawing Figures

CONTAINER GRAB

The present invention relates to a container grab comprising co-operating jaws attached to a frame, between which jaws a container rim is accommodated.

Such a container grab is known.

The invention has for its object to provide a new container grab, the mutual moving parts whereof are supported and/or guided as much as possible, so that in use damages and/or deformations are prevented as much as possible. This is achieved according to the invention by attaching the under jaw to a carriage slidable along a frame column comprised in said frame and by attaching the upper jaw to one end of a lever pivotally attached to said carriage, the other end of said lever being coupled via a link with said frame column.

If the point of rotation of the link about the frame column can be brought between a point of rotation of said link with the other lever end and a fixed point of rotation of the lever on the carriage, the point of rotation of said link about said frame column is brought through the so-called dead point, and the upper and under jaw, which are thereby situated in a closed position, are assured against mutual displacement.

In order to limit the open position as well as the closed position of the co-operating jaws, it is recommended that the frame column is provided with stops which limit the slide of the carriage along said frame column.

In order to be able to adjust the co-operating jaws of the container grab to the rim of different types of drums, it is recommended that the under jaw is attached to the carriage via adjusting means.

In order to prevent undesired displacement of the co-operating jaws from the closed position to the opened position as a result of a sudden change of height of the container grab, for example because the fork lift truck carrying said container grab drives over a hole, it is recommended that pivoting means are incorporated in the frame, whereby the co-operating jaws are pivotable upwards and downwards, and that spring means are arranged between said frame and said pivoting means such as said spring means are under load during downward pivoting. In this way sudden changes in height are decelerated before being passed onto the container grab.

The mentioned and other characteristics will be explained on the basis of a non-limitative embodiment of the container grab according to the invention given by way of example, with reference to the annexed drawing.

In the drawing:

FIGS. 1 and 2 each show, on a different scale, a perspective partly broken away view of the container grab according to the invention, having the co-operating jaws in respectively the opened position and the closed position;

Figure 1:
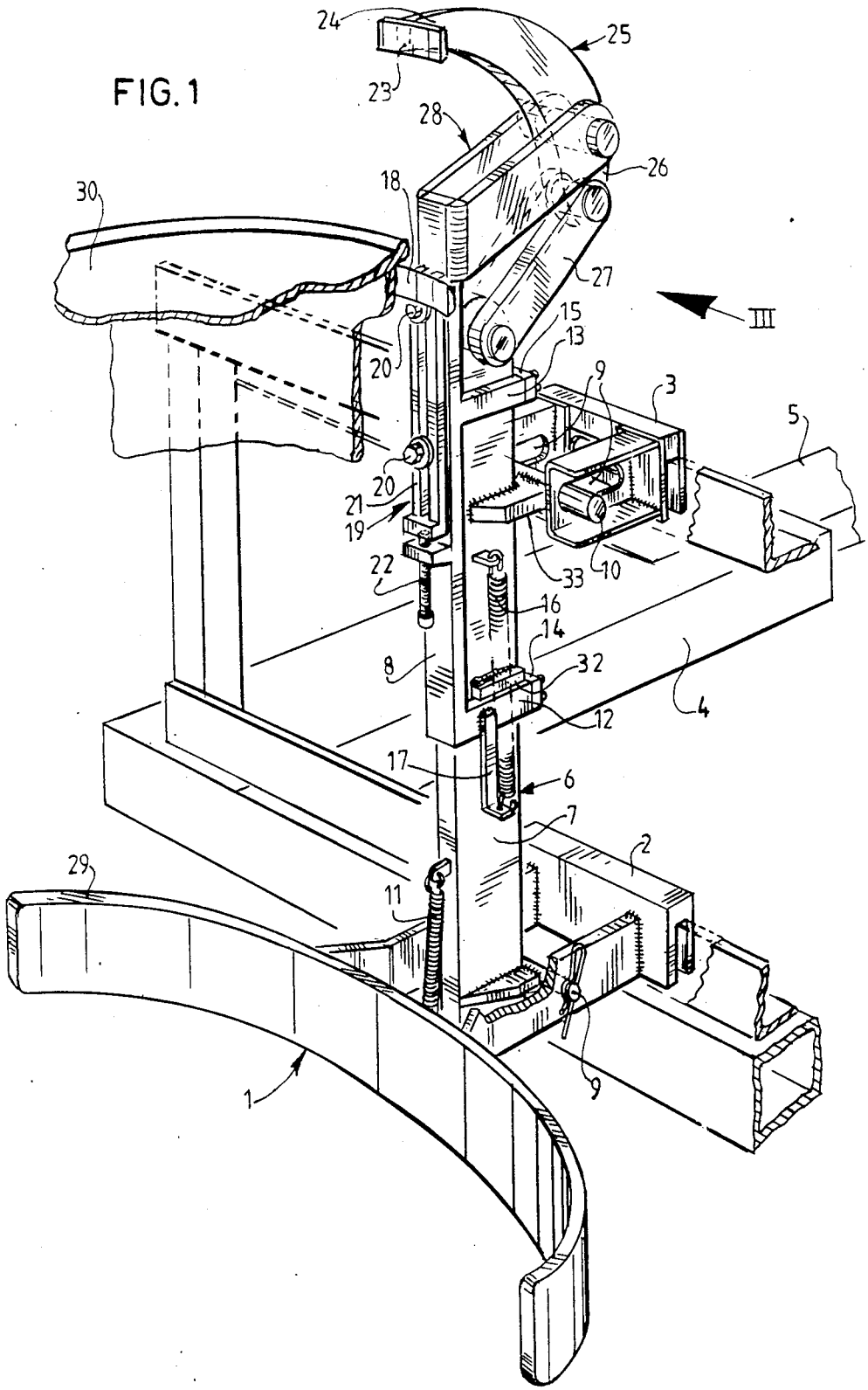

FIG. 1 shows the container grab 1 according to the invention. Said container grab 1 is hooked with the aid of comprised hook pieces 2 and 3 on a bearing frame 4 which is arranged on forks 5 of an unshown fork lift truck.

Said container grab 1 comprises a frame 6 further comprising a frame column 7 and a carriage 8 slidable along said column 7.

The frame column 7 is tiltable around a shaft 9, whereby the tilting movement is restricted by the slotted holes 9 arranged in hook piece 3, in which holes a rod 10 attached to said frame column is slidable. Using a spring 11, said column is held in a forward inclined position in a direction away from the fork lift truck.

The carriage 8 comprises two guide elements 12 and 13 enclosing said frame column, which elements can be arranged around said column by mounting or detaching the strips 14 and 15 which are disconnectably attached with the aid of bolts to the remaining parts of said guide elements 12 and 13.

An under jaw 18 is attached to the carriage 8 via adjusting means 19 comprising an adjusting piece 21 guided along bolts 20, the placing of which piece relative to said carriage 8 being adjustable using an adjusting screw 22. After reaching the correct position, said adjusting piece 21 is fixed to said carriage 8 with the aid of bolts 20.

An upper jaw 23 co-operating with the under jaw is attached to one end 24 of a lever 25, the other lever end 26 of which is connected via a link 27 with frame column 7. Said lever 25 is pivotally attached to carriage 8 in the yoke 28.

In addition the container grab 1 comprises a bracket 29 which comes to rest against the body of the drum 30 to be gripped.

Figure 2:
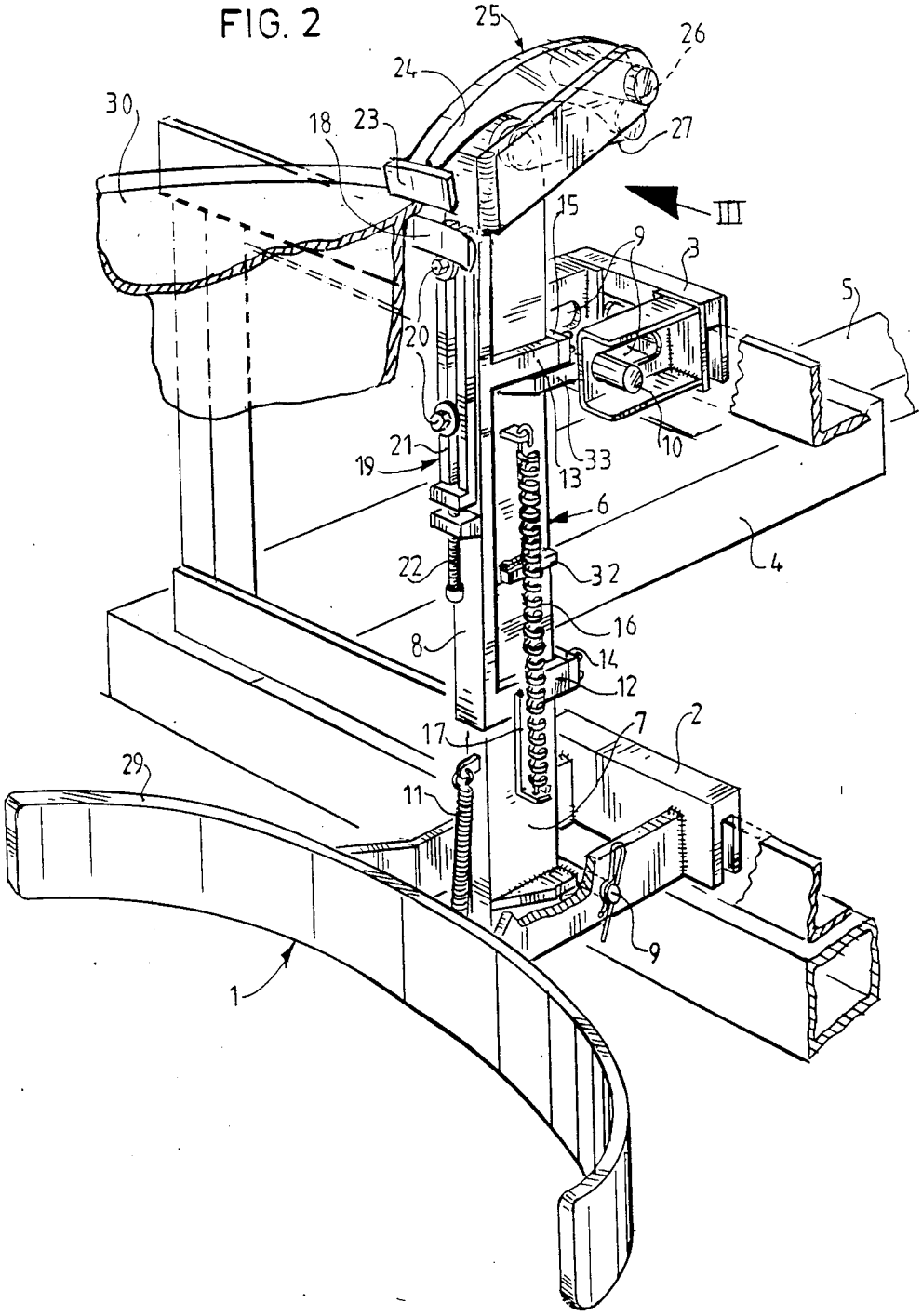
Figure 3:
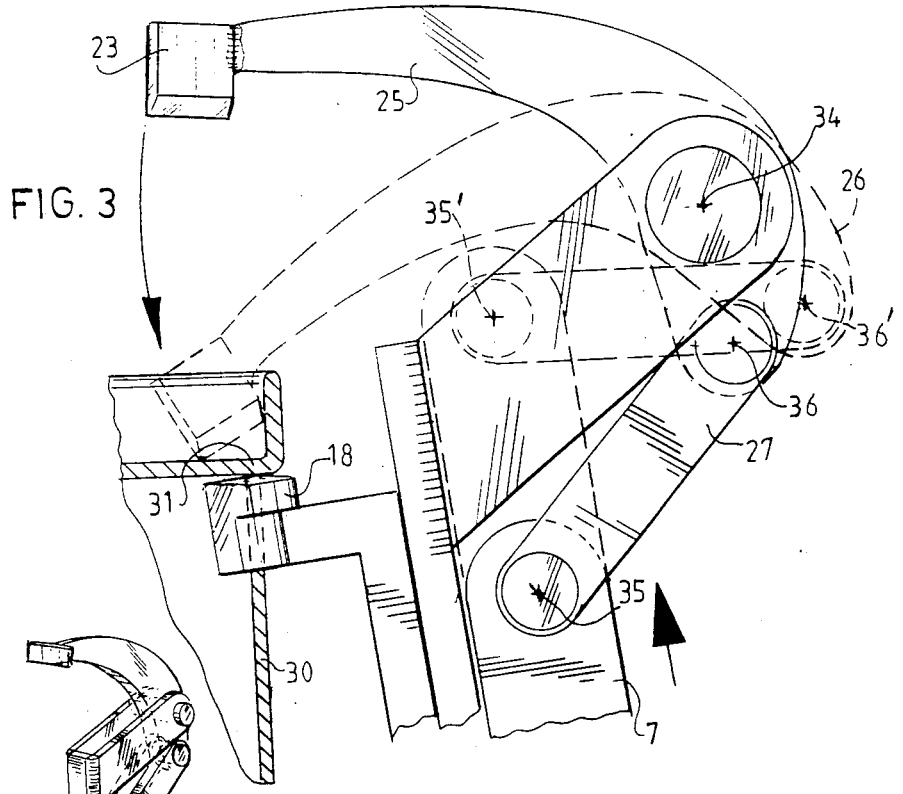
FIG. 3 shows on a larger scale a composite view of detail III from FIGS. 1 and 2.

The operation of the container grab 1 according to the invention will be explained on the basis of FIGS. 1, 2 and 3. During gripping of the drum 30, the under jaw 18 is brought under drum rim 31. By subsequently displacing the container grab 1 upwards with the aid of the fork lift truck, a relative displacement occurs between on the one hand the carriage 8 and on the other the frame column 7, whereby said column 7 displaces as shown in FIG. 3 from the position drawn with full lines to a position drawn in dashed lines. This displacement goes counter to the spring action of a spring attached between column 7 and via a corner piece to carriage 8. The distance which can be covered during this displacement is limited with the aid of stops 32 and 33.

During the displacement of the frame column 7 relative to the carriage 8, the lever 25 rotates around the fixed point of rotation of said lever 25 on said carriage 8, so that the upper jaw 23 is moved towards the under jaw 18, so that drum rim 31 is accommodated between both said jaws 18 and 23. Because a point of rotation 35 of the link 27 around frame column 7 is brought during displacement past the point of rotation 36 of said link 27 with the other lever end 26, said link 27 lies beyond the dead point, so that in the closed position of the co-operating jaws 18, 23 (the position shown with dashed lines) said jaws are assured against any change towards the opened position.

Figure 4:
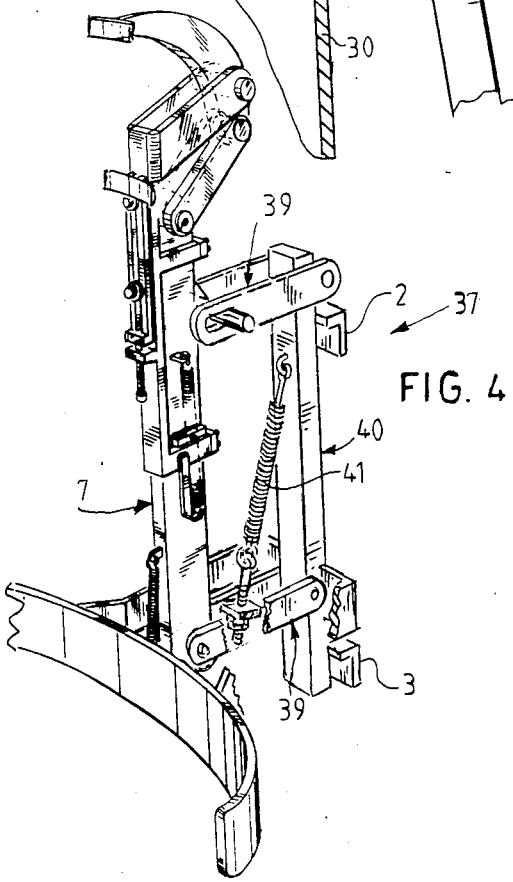
FIG. 4 shows on a smaller scale a variant of the container grab shown in FIGS. 1 and 2.

In order to prevent, as a result of a sudden change of height, the pressure of the drum rim 31 on the under jaw 18 being lost and pressure being applied to the upper jaw 23, whereby the possibility exists of the column 7 being forced back into the position indicated by the full lines, whereby the jaws are moved away from one another, this sudden change of height has to be absorbed. For this purpose the frame 38 of the container grab 37 comprises according to FIG. 4 a frame 40 which is attached via upward and downward pivoting means to the frame column 7. Spring means are arranged between said frame 40 and said pivoting means 39 such that with a sudden change of height downwards, said frame column 7 is forced back counter to the spring force of spring means 41 into the original position, wherein said spring means 41 are under load of the weight of the gripped container.

Figure 5:
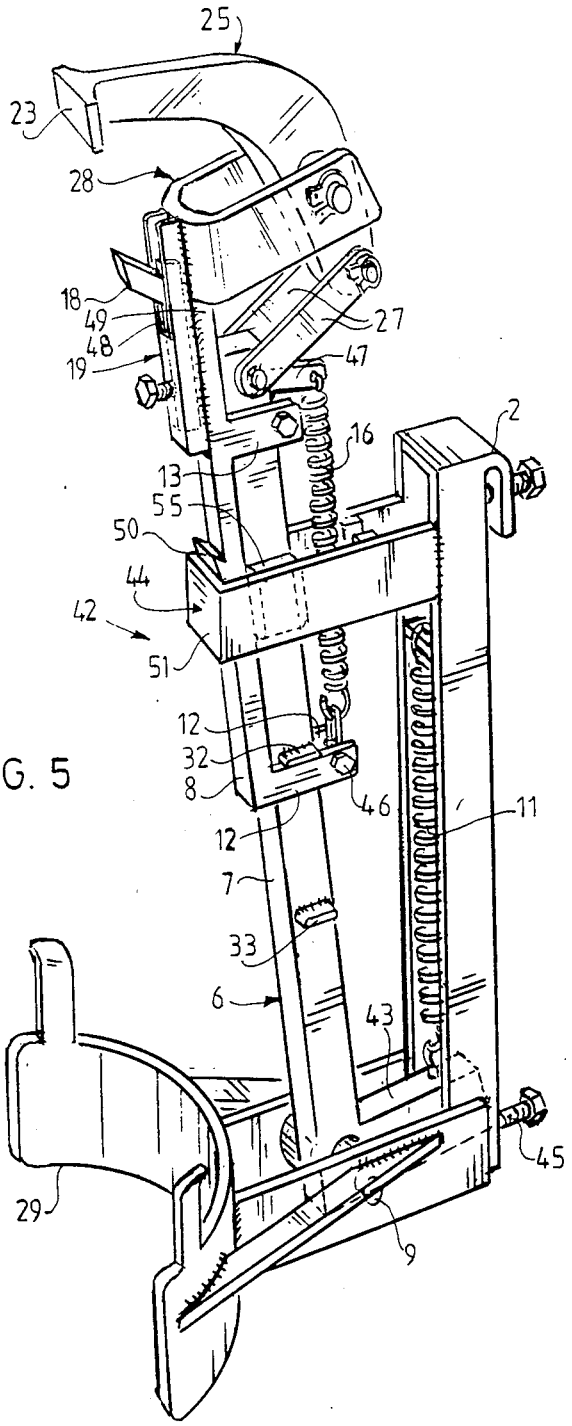
FIG. 5 shows on another scale a second variant of the container grab according to the invention.
Figure 6:
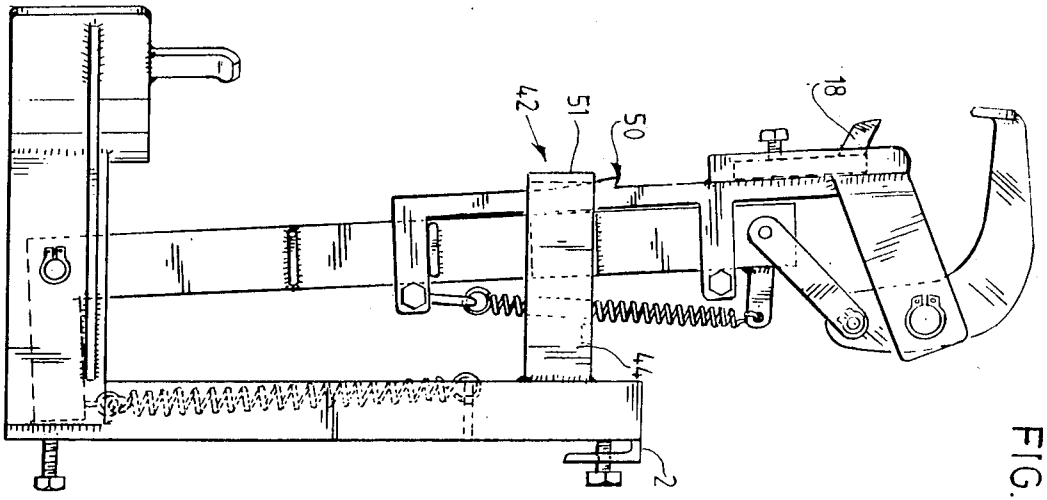
FIGS. 6 and 7 each show a side view of the container grab shown in FIG. 5, in the closed and opened position, respectively.
Figure 7:
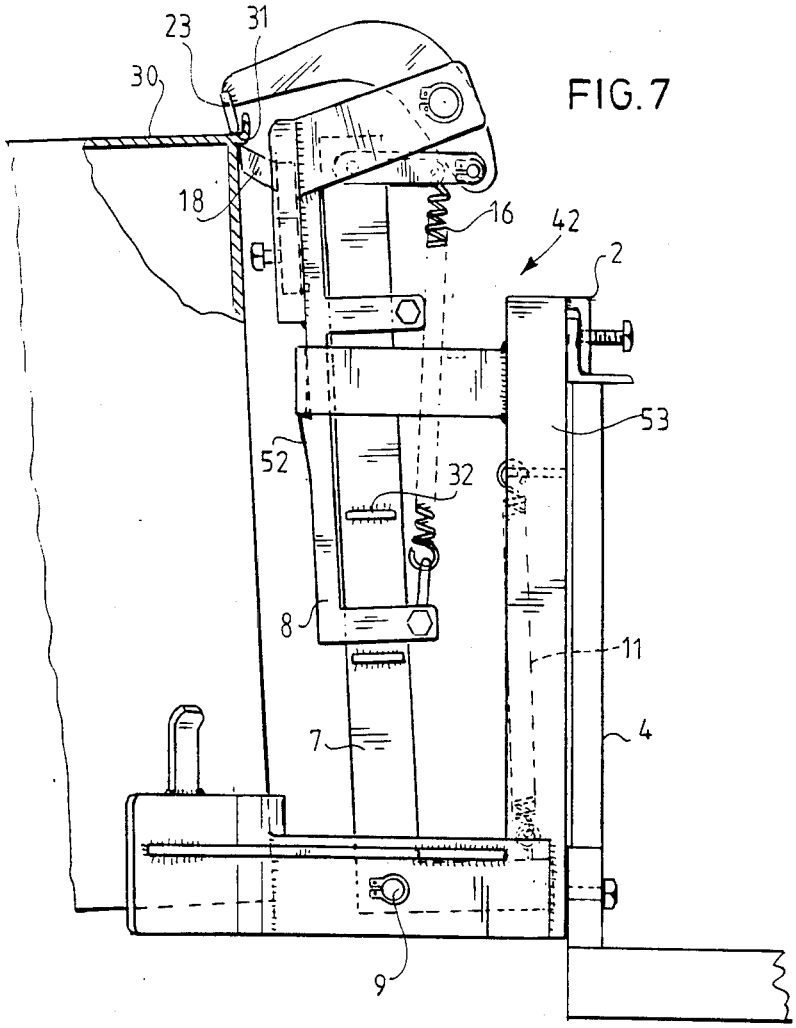

FIGS. 5 to 7 show a second variant of a container grab 42 according to the invention. In comparison with the container grabs 1 and 37, identical and/or equivalent construction elements are indicated with the same reference number.

Said frame column 7 tiltable around the shaft 9 is provided with a traverse element 43. The tilting movement is on the one hand delimited by the bow 44, and on the other hand by the setting bolt 45 co-operating with the element 43. Using a spring 11 the frame column 7 is forced to the forward inclined position. Guiding means of the frame column 7 consists of two guiding soles 55.

The movement of the carriage 8 along the frame column 7 is limited by the stops 32, 33 co-operating with the strip 12. The spring 16 is stretched between a bolt 46 connected with the strips 12, and a finger 47 attached to the frame column 7, and forces the carriage 8 in an upward direction, so that the jaws 18, 23 take the opened position.

The under jaw 18 is slidably taken up in a sheath 48 comprised by the adjusting means 19. The sheath 48 is elongated and extends along and is attached to the yoke 28, so that under extreme condition (exceptional heavy containers) a deformation of the extended part 49 of the carriage 8 and the yoke 28 is avoided.

The carriage 8 further comprises a hook element 50 having a wedge-shaped section, which element 50 co-operates with the body 51 of the bow 44 of the frame 6.

The co-operation of the hook elements 50 and the body 51 of the bow 44 is clearly illustrated in FIGS. 6 and 7. After the under jaw 18 grips under the drum rim 31, and the bearing frame 4 is lifted from the ground, the carriage 8 displaces along the frame column 7, and the upper jaw 23 is swung towards the under jaw 18 clamping the container rim 31 thereinbetween. During the movement of the carriage 8 the body 51 of the bow 44 displaces over the inclined surface 52 of the hook element 50 under tipping around the shaft 9, until the hook element 50 snaps behind the body 51. Thereafter the jaws 18 and 23 under inclusion of the container rim 31 are locked against an undesired opening of the jaws, as by the co-operation between hook element 50 and bow 44 a displacement of the carriage 8 along the frame column 7 is latched.

The latched position is broken if the container 30 is placed on the ground, and the container 30 tilts the frame column 7 to a more upright position so that the hook element is dislocked and the carriage 8 displaces in the direction of the stop 32 and the jaws take in the opened position releasing the container 30.

As the spring 16 and the spring 11 are surrounded by the frame column 7, the bow 44 and the frame case 53, a damage of these vulnerable parts in use is avoided as much as possible.

We claim:

1. Container grab comprising co-operating jaws attached to a frame, between which jaws a container rim is to be accommodated, characterized in that the under jaw is attached to a carriage slidable along a frame column comprised in said frame and the upper jaw is attached to one end of a lever pivotally attached to said carriage, the other end of said level being coupled via a link with said frame column.

2. Container grab as claimed in claim 1, characterized in that the point of rotation of said link about said frame column can be brought between a point of rotation of said link with said other lever end and a fixed point of rotation of said lever on said carriage.

3. Container grab as claimed in claim 1, characterized in that said frame column is provided with stops which limit the slide of said carriage along said frame column.

4. Container grab as claimed in claim 1, characterized in that said carriage is provided with a hook element that co-operates as such with a material strip attached to said frame, that on sliding said carriage along said frame column as to bring the jaws in the closed position, said hook element hooks behind said strip locking the pair of jaws against an undesired opening.

5. Container grab as claimed in claim 1, characterized in that the under jaw is attached to said carriage via adjusting means.

6. Container grab as claimed in claim 1, characterized in that pivoting means are incorporated in the frame, whereby the co-operating jaws are pivotable upwards and downwards, and that spring means are arranged between said frame and said pivoting means such as said spring means are under load during downward pivoting.

7. Container grab as claimed in claim 1, characterized in that reset means for said carriage and said frame column are guarded by said frame.

8. A container grab assembly comprising the combination of a frame adapted to be connected to a lifting apparatus, a carriage vertically movable on the frame, under jaw means carried by the carriage for engaging beneath a rim of a container and thereby imparting downward force on the carriage, upper jaw means pivotally carried by the carriage above the under jaw means for relative swinging motions toward and away from the under jaw means in response respectively to downward and upward sliding of the carriage on the frame, and link means connected between the upper jaw means and the frame for swinging the upper jaw means forcibly toward the under jaw means when the frame is lifted upwardly and the under jaw engages beneath a container rim.

9. A container grab as defined in claim 8 including means normally urging the carriage to an upwardly slid position relative to the frame for defining a gap between the upper jaw means and the under jaw means.

10. A container grab as defined in claim 9 wherein said upper jaw means comprises a lever having an upper jaw at one end thereof, a pivotal connection intermediate its ends defining a fixed point of rotation of the lever on the carriage, and an opposite end to which the link means is pivotally connected, the link means comprising a link pivoted at one end at a point of rotation to the column and at its other end at a point of rotation to the opposite end of the lever.

11. A container grab assembly for grabbing a circumferential point of the upper rim of a container as it is lifted while stabilizing the container in generally upright condition, comprising the combination of a frame adapted to be connected to a lifting apparatus, the frame including an upstanding column, a carriage longitudinally slidable on the column, bracket means on said frame below said carriage for engaging the body of the container, under jaw means carried by the carriage for engaging beneath a rim of a container, upper jaw means pivotally carried by the carriage for relative swinging motions toward and away from the under jaw means in response respectively to downward and upward sliding of the carriage on the column, means normally urging the carriage to an upwardly slid position relative to the column for defining a container rimaccepting gap between the upper jaw means and the under jaw means, and link means connected between the upper jaw means and the column for swinging the upper jaw means forcibly toward the under jaw means when the frame is lifted upwardly and the under jaw engages beneath a container rim to force the carriage downwardly on the column.

12. A container grab as defined in claim 11 including means for mounting the column on the frame for limited tilting with relation thereto between a forwardly tilted position in which the under jaw means is disposed forwardly of the bracket means and a rearwardly tilted position in which the under jaw means is disposed rearwardly of the bracket means.

13. A container grab as defined in claim 12 wherein said upper jaw means comprises a generally horizontally disposed lever having an upper jaw at one end thereof, pivot means for defining a first pivotal connection point of an intermediate portion of the lever to the carriage, and an opposite end to which the link means is pivotally connected, the link means comprising a link pivoted at one end at a fixed pivotal connection point with the column and at its other end at a further pivotal connection point with the opposite end of the lever.

14. A container grab as defined in claim 13 wherein the fixed pivotal connection point is below the further pivotal connection point when the upper and under jaw means define a container rimaccepting gap and is above the further first pivotal connection point when the jaw means grippingly engage the container.

15. A container grab comprising the combination of an upstanding column adapted to be vertically lifted by lifting apparatus, a carriage guided for vertical movement on the column, under jaw means attached to the carriage for engaging beneath a container rim, a lever having upper jaw means at one end, pivot means for pivotally connecting an intermediate portion of the lever to the carriage, a link pivotally connecting the column to the opposite end of the lever, means normally urging the carriage upwardly on the column so that the upper and lower jaw means are swung apart to accept a container rim therebetween with the pivot axis between the link and the column below the pivot axis between the link and the lever, and the link being of a length to position the pivot axis between the link and the column above the pivot axis between the link and the lever when the jaw means are in gripping relation to a container rim in response to downward shifting of the carriage with respect to the column by virtue of engagement of the under jaw means beneath a container rim with continued upward movement of the column.

16. A container grab comprising the combination of a frame adapted to be vertically raised and lowered by lifting apparatus, carriage means guided on the frame for vertical movement relative thereto, first jaw means mounted on the carriage means and second jaw means mounted on the frame, and means for causing said jaw means to move into gripping relation in response to movement of the carriage means in one direction along the frame and into spaced apart relation in response to opposite movement of the carriage means with respect to the frame.

17. A container grab as defined in claim 16 wherein said means for causing includes a link joining the two jaw means which is movable into locking, over center position when the jaw means are in gripping relation.

18. A container grab as defined in claim 17 wherein the first jaw means is an under jaw means and commences movement of the carriage means upwardly along the frame to move the jaw means into gripping relation when the first jaw means engages beneath a container rim which is to be gripped.

* * * * *